US006062929A

United States Patent [19]

Hällström

[11] Patent Number: 6,062,929

[45] Date of Patent: May 16, 2000

[54] FLOAT GARMENT

[75] Inventor: Peter Hällström, Vallentuna, Sweden

[73] Assignee: Buffers AB, Vallentuna, Sweden

[21] Appl. No.: 09/091,546

[22] PCT Filed: Dec. 6, 1996

[86] PCT No.: PCT/SE96/01608

§ 371 Date: Jun. 22, 1998

§ 102(e) Date: Jun. 22, 1998

[87] PCT Pub. No.: WO97/27101

PCT Pub. Date: Jul. 31, 1997

[30] Foreign Application Priority Data

Jan. 23, 1996 [SE] Sweden ..... 9600241
Sep. 30, 1996 [SE] Sweden ..... 9603563

[51] Int. Cl.[7] ..... B63C 9/08

[52] U.S. Cl. ..... 441/106; 441/114; 441/117; 441/119

[58] Field of Search ..... 441/88, 106, 107, 441/108, 125, 89, 102, 111, 114, 115, 116, 117, 119, 124

[56] References Cited

U.S. PATENT DOCUMENTS

| | | | |
|---|---|---|---|
| 2,521,205 | 9/1950 | David . | |
| 3,345,657 | 10/1967 | Peeler et al. | 9/316 |
| 4,097,947 | 7/1978 | Kiefer . | |
| 4,655,718 | 4/1987 | Kycuys | 441/106 |
| 4,673,366 | 6/1987 | Hawkins . | |
| 5,060,314 | 10/1991 | Lewis . | |
| 5,152,706 | 10/1992 | Fister | 441/106 |
| 5,326,297 | 7/1994 | Loughlin | 441/89 |
| 5,459,874 | 10/1995 | Meredith | 2/67 |
| 5,584,737 | 12/1996 | Luhtala | 441/107 |

FOREIGN PATENT DOCUMENTS

| | | |
|---|---|---|
| 2214405 | 9/1989 | United Kingdom . |
| 96/24816 | 8/1996 | WIPO . |

*Primary Examiner*—S. Joseph Morano
*Assistant Examiner*—Patrick Craig Muldoon
*Attorney, Agent, or Firm*—Burns, Doane, Swecker & Mathis, L.L.P.

[57] ABSTRACT

Vest-like flotation garment including a buoyant work vest and a flotation unit attached to the work vest in order to enhance the buoyancy of the work vest. The work vest includes a wear-resistant surface layer and an inner lining, between which is arranged at least one elastic and shape-permanent flotation body. The flotation unit includes one or more flotation members arranged on the front part of the work vest and extending around its neck section. The flotation unit is detachably fixed to the work vest with the aid of a first fastening device, one member of which is arranged at the neck section of the work vest and the other member of which is arranged at the neck section of the flotation unit, and a second fastening device, one member of which is arranged on a portion of the flotation member spaced from the neck section and the other member of which is arranged on the front part of the work vest. The flotation unit further includes a wear-resistant outer layer and an inner lining, between which is arranged at least one elastic and shape-permanent flotation body.

15 Claims, 1 Drawing Sheet

FLOAT GARMENT

Figure 1:
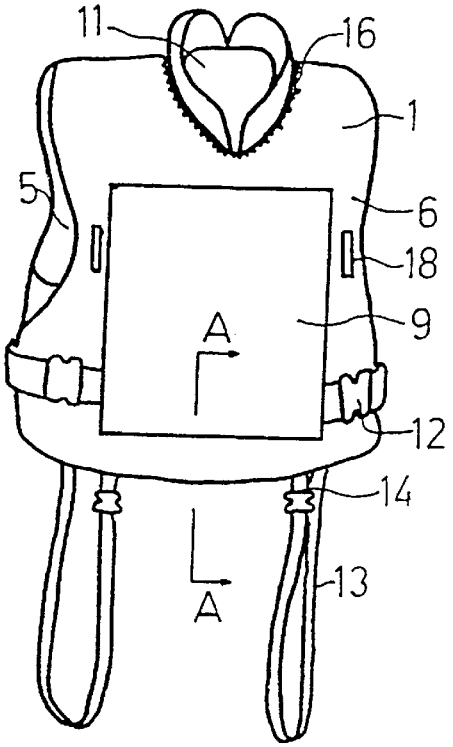

The present invention relates to a vest-like flotation garment comprising a buoyant work vest and a flotation unit attached to the work vest in order to enhance the buoyancy of the work vest, said work vest comprising a wear-resistant surface layer and inner lining, between which is arranged at least one elastic and shape-permanent flotation body, and the flotation unit comprising one or more flotation members arranged on the front part of the work vest and extending around the neck section thereof.

The invention primarily relates to buoyant ballistic body-protection vests or so-called bulletproof vests, but is also intended for use in work vests for, for example, bridge-builders and seamen and to function as a sailing vest.

Work vests and sailing vests are flotation aids only and exist in a number of designs, all of which have different types of flotation devices sewn into them or applied to them. Their purpose is to make drowning more difficult and to make it easier for a conscious wearer to get out of the water. To achieve protection against drowning in a state of unconsciousness, a life-saving jacket or a flotation garment which correctly turns the wearer face-up and maintains the face out of the water is required. The disadvantage of the life-saving jacket is that it is relatively bulky and large, with the result that the wearer's range of movement becomes restricted, making it difficult to perform physical work. The range of movement becomes limited if a life-saving jacket is worn on top of a work vest, making certain operations impossible. When it is necessary to choose between a work vest and a life-saving jacket, situations arise where, for example, a ballistic body-protection vest cannot be used in place of a life-saving jacket and vice versa. From a practical point of view, it may also be the case that only one garment can be carried along or handled during a sea voyage, which, of course, impedes the individual's ability to adjust the anti-drowning or body-protection devices correctly to the varying conditions which occur.

A flotation garment, consisting of a work vest or a sailing vest with flotation blocks and an outer vest having a neck-collar and attached to said first vest, between which an inflatable bladder is provided, is known from U.S. Pat. No. 4,097,947. When the flotation garment is used as a sailing vest, the bladder is empty and contained between the vests in order to make the flotation garment relatively pliable. However, when the flotation garment is to be used as a life-saving jacket, the bladder is inflated and edge portions of the outer vest are detached from the sailing vest in order not to impede the expansion of the bladder. The outer vest cannot be removed from the inner vest, which reduces the pliability of the work vest and makes it too warm when the wearer is working. Furthermore, there is always a risk that the bladder may be punctured by sharp objects or projectiles if it is used a bulletproof vest, resulting in the loss of its function as a life-saving jacket. Finally, the inner as well as the outer vest are divided in the area along the symmetry line of the front panels, which means that this area is particularly exposed to damage. The preamble of the main claim is based upon this patent specification.

The object of the present invention is to overcome the above-mentioned drawbacks and to provide a flotation garment which on the one hand functions well as a work vest which is able to keep the wearer afloat and on the other hand can function as a life-saving jacket.

A further object of the invention is to provide a flotation garment whose function is not jeopardised by penetrating objects.

Yet another object is to provide a ballistic body-protection vest in the form of a flotation garment.

According to the invention, these objects are achieved by a flotation garment according to the opening paragraph, characterised in that the flotation unit is detachably fixed to the work vest with the aid of a first fastening means, one member of which is arranged at the neck section of the work vest and the other member of which is arranged at the neck section of the flotation unit, and a second fastening means, one member of which is arranged on a portion of the flotation member spaced from the neck section and the other member of which is arranged on the front part of the work vest, and that the flotation unit comprises a wear-resistant outer layer and an inner lining, between which is arranged at least one elastic and shape-permanent flotation body.

Further developments of the invention can be seen from the features mentioned in the subclaims.

Figure 2:
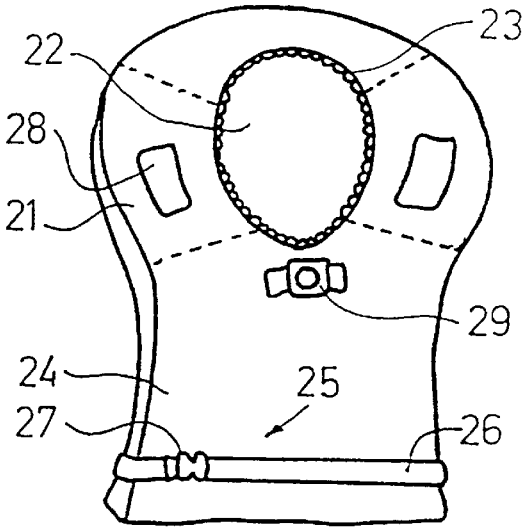
Figure 4:
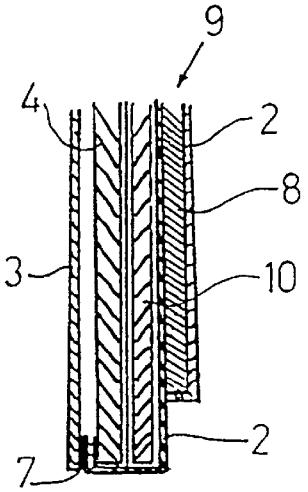
Figure 3:
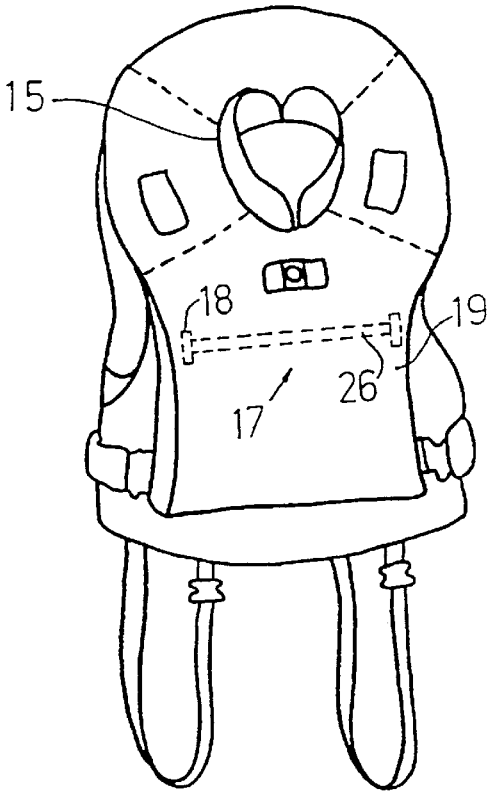

By way of example, a preferred embodiment of the invention will be described in more detail below with reference to the accompanying drawings, in which:

FIG. 1 is a front perspective view of a work vest or a sailing vest which is part of the flotation garment according to the invention, FIG. 2 is a perspective view similar to that of FIG. 1 of a flotation unit which is part of the flotation garment according to the invention, FIG. 3 is a perspective view similar to those of FIGS. 1 and 2 of the flotation garment functioning as a life-saving jacket, and FIG. 4 schematically shows the design of the work vest in a part-section along the line A—A.

In the present invention the above-mentioned inconveniences are obviated by the life-saving jacket's specifically positioned flotation unit around the neck and chest/stomach being made detachable. This gives the user flexibility as it is easy to either upgrade a work vest to a life-saving jacket to increase safety or to downgrade the life-saving jacket to a work vest to increase the range of movement. Further advantages are achieved in that the invention provides new opportunities for combining the work vest with different types of flotation units or for using it separately without the range of movement being reduced to an unacceptable low level.

In order for the inventive idea to be realised, the invention is essentially characterised in that the flotation unit is designed to be detachable from and attachable to a basic vest without the wearer having to remove the basic vest or the work vest.

Referring now to FIGS. 1 and 4 in particular, the flotation garment according to a preferred embodiment of the invention comprises a work vest, a sailing vest, a basic vest, a body-protection vest or the like, which is generally designated by reference numeral 1. The work vest 1 consists of a wear-resistant or tear-resistant outer layer 2 of one or more layers of nylon fabric, cotton fabric or some other suitable material. An inner lining 3 is fixedly secured to the outer layer along its edge area. Between the outer layer 2 and the inner lining 3 are arranged one or more flotation bodies 4. The flotation body or bodies, which are elastic and shape permanent, i.e. they maintain their shape, are made of sheet-shaped members of polyurethane foam material, so-called bubble-foil, polyethylene or polyvinyl chloride foam with closed cells or the like in at least one layer. Preferably, the outer layer 2 and the lining 3 are detachably fixed to each other at the lower portions of the back part 5 and front part 6 of the vest 1 by means of Velcro tape 7, see FIG. 4. In this case, both the front part 6 and the back part 5 are formed like a pocket, into which the flotation bodies 4 are interchangeably inserted. In this way the buoyancy of the work vest 1 can be adjusted to the weight of the wearer. If desired, it is also possible to have flotation bodies in the pocket of the front part 6 only, not in the pocket of the back part 5.

When the work vest 1 is used as a ballistic body-protection vest, a ballistic panel or layer 10 is inserted into the pockets of the front part and the back part respectively between the flotation bodies 4 and the outer layer 2, or as the only object in the pocket of the back part 5. The shape of the panel 10 essentially corresponds to that of the front part and the back part respectively. Preferably, the body-protection vest also has a collar (not shown) around the neck section 11 which is constructed in the manner described above. The protective effectiveness of the work vest can be enhanced by means of a protective plate 8, which can be inserted into an openable pocket 9 on the front part 6 and the back part 5 respectively. Preferably the pocket is closed with Velcro tape (not shown).

The work vest 1 is formed in one integral piece, i.e. its neck section 11 is not connected to the edge section of the vest 1 by means of, for example, a (sealable) opening or slit. Furthermore, the vest is kept in place around the trunk of the wearer by means of a buckle 12 placed apart from the respective armpits of the wearer. Preferably the buckle is a quick-coupling buckle or clip or a mortise lock. It is, of course, also possible to use the type of straps which are found in conventional sailing vests and the like. Furthermore, the work vest is conveniently provided with crotch straps 13 with buckles 14 and a lifting sling (not shown) on the back part 5 in the vicinity of the neck section in a manner known per se.

In order to allow the detachable coupling of the work vest to a flotation unit, which will be described in more detail below, one member 16 of the first fastening means 15 (see FIG. 3) is arranged at and along the neck section 11 of the vest 1 in an essentially circumferential manner. In the illustrated embodiment, the first fastening means 15 is a zipper, but Velcro tape, press-studs, or the like can also be used. With the aid of a second fastening means 17, schematically illustrated by dashed lines in FIG. 3, suitably the lower portion, or the portion spaced from the neck section, of the flotation unit is detachably fixed to the front part 6 of the work vest. The second fastening means 17 may be of a design similar to that of the first fastening device 15 but has here been schematically illustrated as a clampstrap-construction. Thus, a pair of clamps, straps, loops, buckles or the like 18 are stitched onto the front part 6 at its opposite edge sections.

Referring now to FIG. 2 which illustrates a flotation unit 19 intended to be detachably fixable to the work vest 1 in order for the latter to be upgraded to a life-saving jacket. The flotation unit 19 comprises a flotation collar 21 with a neck section 22, which is intended to be attached to the neck section 11 of the work vest by means of the second member 23 of the first fastening means 15 in coaction with the member 16 on the work vest 1. Furthermore, the flotation unit comprises a flotation cushion 24, which is integrated with the flotation collar 21 and which advantageously is constructed in a manner similar to the front part 6 and the back part 5 of the work vest. However, in certain applications of the invention it may be suitable to replace the lining with an inner layer similar to the outer layer. The elastic and shape-permanent flotation bodies of the flotation collar 21 are nevertheless conveniently sewn into pockets in the flotation collar.

At the lower section, i.e., a section placed apart from the neck section 22, of the flotation cushion 24, the second member 25 of the second fastening means 17 is arranged to interact with the member (clamps or the like) 18 on the work vest. A belt 26 with buckle 27 is stitched onto the flotation cushion 24, the belt 26 being pulled through both clamps or the like 18 on the front part of the work vest 1 and being secured by means of the buckle 27 when the flotation unit 19 is being secured to the work vest 1. Conveniently, the flotation unit 19 is provided with the usual reflective devices 28, distress light 29 and the like, which, however, in certain applications of the flotation garment, are detachably fixed to the flotation unit, for example with Velcro tape.

As result of the design of the flotation garment according to the invention, the flotation unit can be attached to and detached from the work vest without the wearer having to remove the latter, something which is of major importance with respect to, for example, ballistic body-protection vests and in cases of imminent danger of man-overboard-situations. Furthermore, a flotation unit of requisite volume need not impede the working capacity of the wearer since, when the wearer is working, the flotation unit can be kept in the vicinity of the wearer rather than on the wearer.

The invention is not limited to what is described above or shown in the drawings, but can be modified within the scope of the claims.

What is claimed is:

1. A vest-like flotation garment comprising;

buoyant work vest and a flotation unit attached to the work vest in order to enhance the buoyancy of the work vest, the work vest comprising a wear-resistant outer layer and an inner lining, between which is arranged at least one elastic and shape-permanent flotation body, and the flotation unit comprising one or more flotation members arranged on the front part of the work vest and extending around the neck section thereof, wherein the flotation unit comprises a body flotation cushion integrated with a neck flotation collar, said flotation unit being detachably fixed to the work vest with the aid of a first fastening means, one member of which is arranged at the neck section of the work vest and the second member of which is arranged at the neck section of the flotation collar, and a second fastening means, one member of which is arranged on a portion of flotation cushion spaced from the neck section and the second member of which is arranged on the front part of the work vest, and wherein the flotation unit comprises a wear-resistant outer layer and an inner lining, between which is arranged at least one elastic and shape-permanent flotation body.

2. A flotation garment as set forth in claim 1, wherein the outer layer and the lining of the work vest and the flotation unit respectively, are fixedly secured to each other along their peripheral edges, with the exception of a shorter edge section where the outer layer and the lining are detachably fixed to each other in order to allow replacement and selective insertion of flotation bodies.

3. A flotation garment as set forth in claim 1, wherein the front part and the back part of the work vest placed apart from a shoulder portion are detachably connected to each other with the aid of a pair of buckles.

4. A flotation garment as set forth in claim 1, wherein the neck section of the work vest is detachably fixed to the neck section of the flotation unit.

5. A flotation garment as set forth in claim 4, wherein the neck section of the work vest is detachably fixed to the neck section of the flotation unit with a zipper.

6. A flotation garment as set forth in claim 4, wherein the neck section of the work vest is detachably fixed to the neck section of the flotation unit with Velcro tape.

7. A flotation garment as set forth in claim 1, wherein the work vest as well as the flotation unit are formed in one integral piece.

8. A flotation garment as set forth in claim 1, wherein the work vest is provided with crotch straps with buckles.

9. A flotation garment as set forth in claim 1, wherein the flotation unit is provided with a reflective device.

10. A flotation garment as set forth in claim 9, wherein the flotation unit is provided with a distress light which is attached to the flotation unit by means of Velcro tape.

11. A flotation garment as set forth in claim 1, wherein said flotation bodies are made of sheet-shaped members of polyurethane foam material, bubble-foil, polyethylene or polyvinyl chloride foam with closed cells in at least one layer.

12. A flotation garment as set forth in claim 1, wherein a ballistic panel is inserted into a pocket of the front part and the back part respectively between the flotation bodies and the outer layer, allowing the work vest to function as a ballistic body-protection vest.

13. A flotation garment as set forth in claim 9, wherein the front part and the back part of the work vest exhibit sealable pockets for holding projectile-impeding members.

14. A vest-like flotation garment comprising:

a) a buoyant work vest including a front section, a rear section, and a neck opening section, said front and rear sections having a wear-resistant outer layer and an inner lining, between which is arranged at least one elastic and shape-permanent flotation body;

b) a flotation unit having at least a front section and an integral neck opening section, said neck opening section including a flotation collar, at least said front section having a wear-resistant outer layer and an inner lining, between which is arranged at least one elastic and shape-permanent flotation body;

wherein said flotation unit is removably attached to the work vest by a first fastening means, one member of which is arranged at the neck section of the work vest and the second member of which is arranged at the neck section of the flotation collar, and a second fastening means, one member of which is arranged on a portion of the flotation cushion spaced from the neck section and the second member of which is arranged on the front part of the work vest;

wherein said work vest is reversibly upgradable to form said flotation garment by placing said flotation device over a user's head and interconnecting said opposing first and second members of said first and second fastening means, said flotation garment providing greater buoyancy than said work vest.

15. A flotation garment as set forth in claim 14, wherein the outer layer and the lining of at least one of said work vest and said flotation device are detachably connected so as to allow selective insertion and replacement of said at least one flotation body.

* * * * *